United States Patent [19]

Salani et al.

[11] 4,367,054

[45] Jan. 4, 1983

[54] VIBRATORY ROLLER

[75] Inventors: Chittaranjan Salani, Springfield; Gary L. Jackson, South Charleston, both of Ohio

[73] Assignee: The Koehring Company, Brookfield, Wis.

[21] Appl. No.: 237,596

[22] Filed: Feb. 24, 1981

[51] Int. Cl.[3] ..... E01C 19/38

[52] U.S. Cl. ..... 404/117; 74/61; 74/87; 366/116

[58] Field of Search ..... 404/117, 72; 74/87, 74/61; 366/116

[56] References Cited

U.S. PATENT DOCUMENTS

| | | | |
|---|---|---|---|
| 2,989,869 | 6/1961 | Hanggi | 74/87 X |
| 3,606,796 | 9/1971 | Pappers | 404/117 X |
| 3,616,730 | 11/1971 | Boone | 404/117 |
| 3,814,532 | 6/1974 | Barrett | 404/117 |
| 3,822,604 | 7/1974 | Grimmer | 74/87 |
| 3,909,147 | 9/1975 | Takata | 404/117 |
| 3,966,344 | 6/1976 | Haker | 404/117 |
| 4,105,356 | 8/1978 | Loveless | 404/117 |
| 4,221,499 | 9/1980 | Breitholz | 404/117 |

*Primary Examiner*—Nile C. Byers, Jr.

*Attorney, Agent, or Firm*—Burns, Doane, Swecker & Mathis

[57] ABSTRACT

A vibratory roller includes a vibrator operably connected to a rotatable compacting roll. The vibrator is comprised of a rotatable shaft mounted co-axially to the roll and a casing mounted on the shaft and including a chamber and an eccentric mass within the chamber the mass being transversely displaceable in the chamber. Movement of the mass within the chamber provides a variable amplitude for the vibrations induced thereby. The movement of the mass is caused by centrifugal force which urges the mass radially outwardly against a fluid storage space radially outwards of the eccentric mass in the chamber, such chamber in turn communicates through a port with a portion of the chamber radially inwards of the eccentric mass. Fluid thus flows from the radially outwards storage space through the port to the radially inwards storage space and the eccentric mass moves radially outwards until the eccentric mass closes off the port.

8 Claims, 3 Drawing Figures

VIBRATORY ROLLER

BACKGROUND AND OBJECTS OF THE INVENTION

This invention relates generally to rollers used in leveling paved or unpaved surfaces. More particularly, this invention concerns a vibratory roller having a variable amplitude of vibration.

In the past, vibratory rollers have been provided with vibrators which include a shaft having a variably positionable eccentric mass. Usually, the variable eccentric mass is adjustable between a plurality of discrete radial positions in order to vary the amplitude of vibration of the roller. In the past, problems existed because of the necessity of stopping the vibrating mechanism in order to adjust the position of the eccentric mass for increasing the amplitude of vibration. Also, the eccentric mass was adjustable between only a few positions within its range of travel, thereby minimizing the available choices of vibratory amplitude.

A significant advance in the art was proposed in U.S. Pat. No. 4,105,356, issued to Loveless on Aug. 8, 1978, and assigned to the assignee of this invention. That patent discloses a fluid system which enables the eccentric weight to be adjusted while the vibratory mechanism is operating, and which provides for an infinite number of positions of adjustment of the mass within its travel range. The fluid system includes a storage reservoir for fluid and a conduit arrangement for connecting the reservoir with an outer end of a chamber containing the eccentric mass. During operation of the vibrating mechanism, the eccentric mass pressurizes the fluid in the outer portion of the chamber, under the urging of centrifugal force. Thus, by operator actuation of a valve in the fluid system to communicate such pressurized fluid with the reservoir, the fluid is ejected from the chamber by the mass, enabling the mass to travel outwardly to any new position in order to increase the amplitude of vibration.

The fluid system includes an indicator visible to the operator to indicate the position of the mass. By viewing the indicator, the operator can monitor the movement of the mass and can close the valve when the desired amplitude of vibration is attained.

While the system proposed in the Loveless patent constitutes a significant step forward, room for improvement remains. For example, it would be desirable to have the eccentric mass automatically stop at a desired position of adjustment without the need for the operator to monitor movement of the mass. It would also be desirable to simplify the system, as by eliminating the need for a hydraulic pump, external fluid storage reservoir, and hydraulic conduits for example.

SUMMARY OF THE INVENTION

These objects are achieved by a vibratory compacting roller which includes a vibrator mechanism operably connected to a rotatable compacting roll to vibrate the latter. The vibrator mechanism includes a shaft rotatable relative to the roll, a casing rotatable with the shaft, which casing includes a chamber and an eccentric mass disposed within the chamber transversely of the shaft. The roller includes a position regulating mechanism for regulating the position of the eccentric mass in the chamber to provide variable amplitude for vibrations induced by the vibrator mechanism. The position regulating mechanism preferably includes a fluid storage space and a passage, including a port which communicates with the chamber, for interconnecting the fluid storage space with a portion of the chamber on an outward side of the eccentric mass so that during rotation of the shaft the mass is displaced outwardly under the influence of the centrifugal force. Outward displacement of the mass pushes fluid from the outer portion of the chamber into the storage space, thereby enabling the eccentric mass to move radially outwardly to increase the amplitude of the vibration. Means is provided for automatically stopping the outward movement of the eccentric mass in response to the latter reaching a preselected position.

Preferably, a valve rod is slidably mounted in the eccentric mass, the rod containing a passage communicating respectively with the fluid storage space and the outer portion of the chamber. The mass blocks the passage when reaching the selected position of adjustment. The fluid storage space is disposed in a portion of the chamber on an inward side of the eccentric mass. Fluid can be returned to the outer portion of the chamber through a valved bleed passage in the mass.

BRIEF DESCRIPTION OF THE DRAWINGS

A preferred embodiment of the invention is shown in the accompanying drawings in which.

DETAILED DESCRIPTION OF A PREFERRED EMBODIMENT OF THE INVENTION

Figure 1:
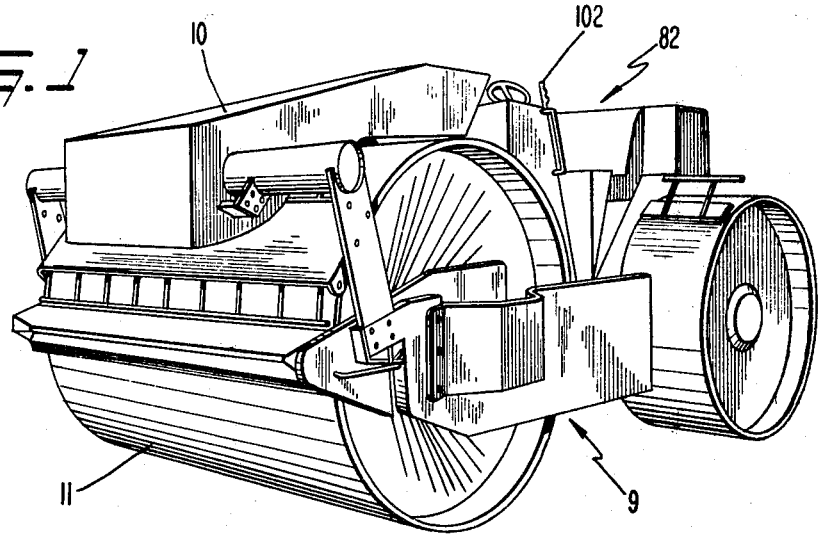
FIG. 1 is a perspective view of a road roller which embodies the present invention.

A road roller 9 for ground compacting, comprises a roller drum 11 rotatably mounted on a vehicle 10 for rotation about a horizontal axis 15 in a conventional manner.

The vibration mechanism includes a shaft assembly 28 comprising a first end portion 30 rotatably mounted in a bearing 32 carried by the roller drum 11, a second end portion 34 rotatably mounted in a bearing 36 also carried by the roller drum 11, and an eccentric bridging portion 38 interconnecting the first and second shaft portions 30, 34. The shaft assembly 28 is rotatably driven via gears 40, 42 by a motor 44 such as a conventional hydraulic motor for example, mounted on the roller drum 11.

Mounted on the bridging portion 38 is a cylindrical casing 46 which extends radially relative to an axis of rotation of the shaft assembly 28, and which defines a chamber 48.

Slidably mounted in the chamber is an eccentric mass 50 which divides the chamber into outer and inner portions 52, 54.

The chamber 48 preferably contains a fluid such as hydraulic oil. Slidably mounted within a sealed throughbore in the mass 50 is a valve rod 56. The valve rod projects through a sealed opening 58 at the bottom of the cylinder 46.

Formed within the rod 56 is a fluid-conducting passage 60. The passage contains an outer port 62 and an inner port 64 for communicating with the outer and inner portions 52, 54, respectively, of the chamber 48.

When the rod 56 is situated such that the outer port 62 is located below the mass 50, fluid in the outer chamber portion 52 communicates with the inner chamber portion 54. In this regard, the diameter of the throughbore 74 is larger than the rod 56 along an extent of the bore situated inwardly of a seal 66 so as to communicate the inner port 64 with the inner chamber portion 54.

A bleed passage 70 is disposed within the mass 50 and interconnects the inner and outer chamber portions 52, 54. A check valve 72 therein permits fluid flow only from the inner to the outer chamber portion.

A coil compression spring 80 is disposed within the outer chamber portion 52 and acts between an end wall 79 of the cylinder and the mass 50 to urge the mass radially inwardly. Attention is directed to copending U.S. application Ser. No. 237,653 filed Feb. 24, 1981 for additional disclosure of the spring.

It will be appreciated from the foregoing that when the mass 50 is rotating about axis 15 and the outer port 62 communicates with the outer chamber portion 52, the mass 50 is shifted radially outwardly under the influence of centrifugal force and displaces fluid from the outer chamber portion to the inner chamber portion (the latter thus defining, in effect, a fluid storage space). When rotation of the mass ceases, the spring 80, having been compressed during outward movement of the mass, returns the mass to its radially inward position while forcing fluid from the inner chamber portion of the outer chamber portion via the bleed passage 70. Seals 65, 66, 67 and 68 prevent leakage of fluid between inner and outer chamber portions as well as leakage from the casing 46.

An actuating mechanism 81 is provided for enabling an operator sitting at an operator's station 82 of the roller to manually slide the rod 56 radially inwardly. The actuating mechanism 81 comprises an arm 84 pivotably mounted between its ends at 86 to a bracket 88, the latter being fixed to the bridging portion 38 of the shaft assembly 28.

One end of the arm 82 includes a curved slot 89 which slidably receives a pin 90 mounted to an upper end of the valve rod 56. Another end of the arm 84 abuts against an end of a bar 92 which is slidably mounted in the second portion 34 of the shaft assembly 28. The other end of the bar bears against a crank 94 pivotably mounted between its ends at 96 to a flange 98, the latter being mounted on the roller drum 11. A portion 99 of the crank is to be connected to a linkage 100 (depicted schematically) which connects to a suitable manual control lever 102 on the roller. By actuating the lever 102, the operator can rotate the crank 94 (clockwise as viewed in FIG. 3) to shift the rod 56 radially inwardly relative to the mass 50 (i.e., raise the rod 56 as viewed in FIG. 3). By actuating the lever 102 in the opposite direction, the bar 92 ceases its pressure on arm 84 so that the latter can pivot in response to a centrifugal force of the rod 56 which acts outwardly because the center of gravity of the rod is always outward of the rotational axis 15.

A scale, not shown, is preferably disposed adjacent the lever 102 so that the operator may selectively position the lever adjacent readings on the scale corresponding to desired amplitudes of vibration.

Figure 3:
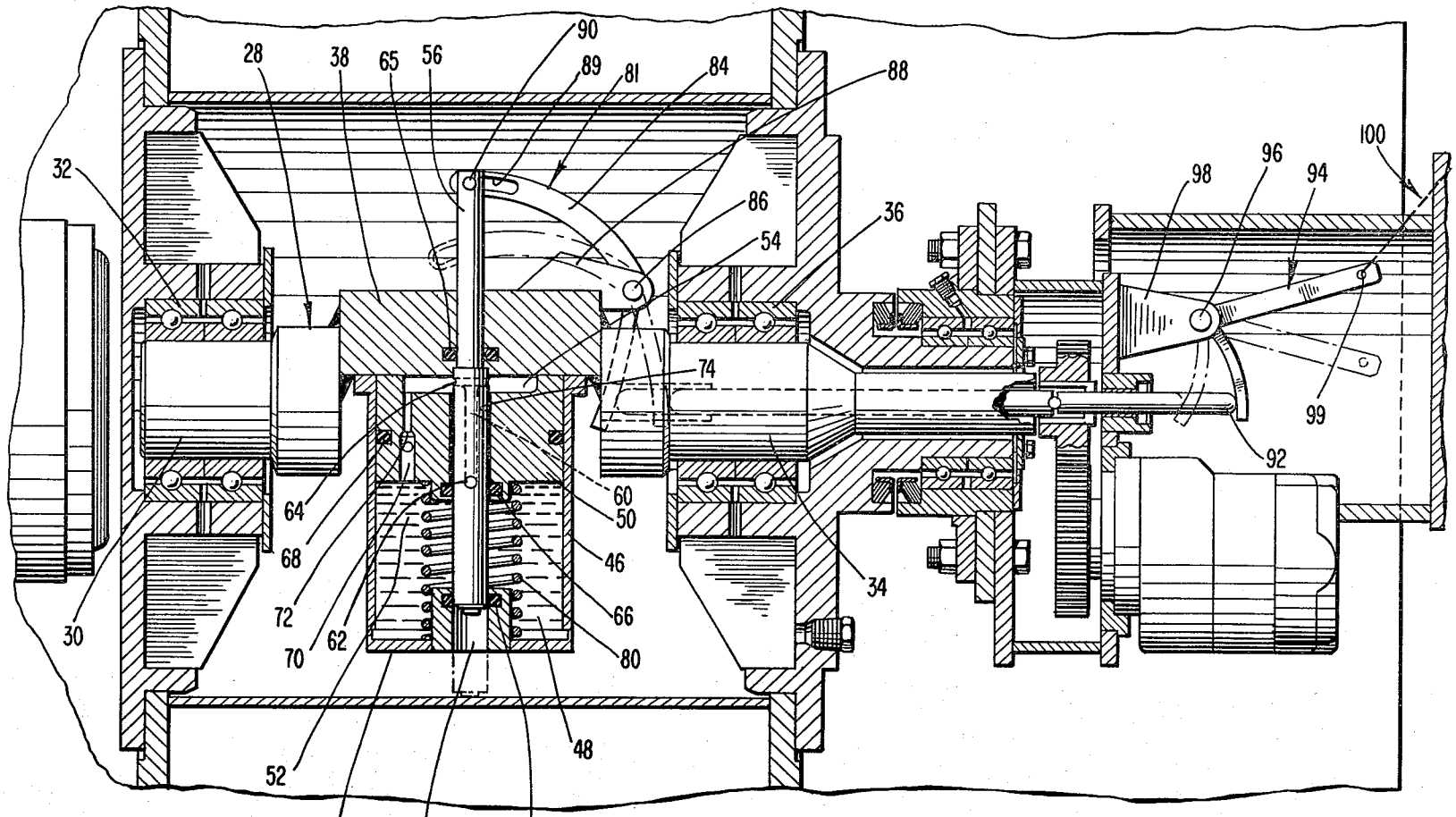
FIG. 3 is an enlarged longitudinal section through the vibrator mechanism.

IN OPERATION, the vibration mechanism assumes the position depicted in FIG. 3 when in a rest condition, i.e., the mass 50 is held against the bridging portion 38 of the shaft assembly 28 by the spring 80. When the vibrating mechanism is initially actuated by rotating the shaft assembly 28, minimum start-up torque requirements are involved due to the fact that the mass 50 is maintained in a radially inward position by the spring 80. As the shaft assembly initially rotates, with the rod 56 disposed as shown in FIG. 3, i.e., with the outer port 62 located within the mass 50, the mass 50 is unable to travel radially outwardly within the chamber 48 under the influence of centrifugal force, since the outer chamber portion 52 is occupied by fluid.

Figure 2:
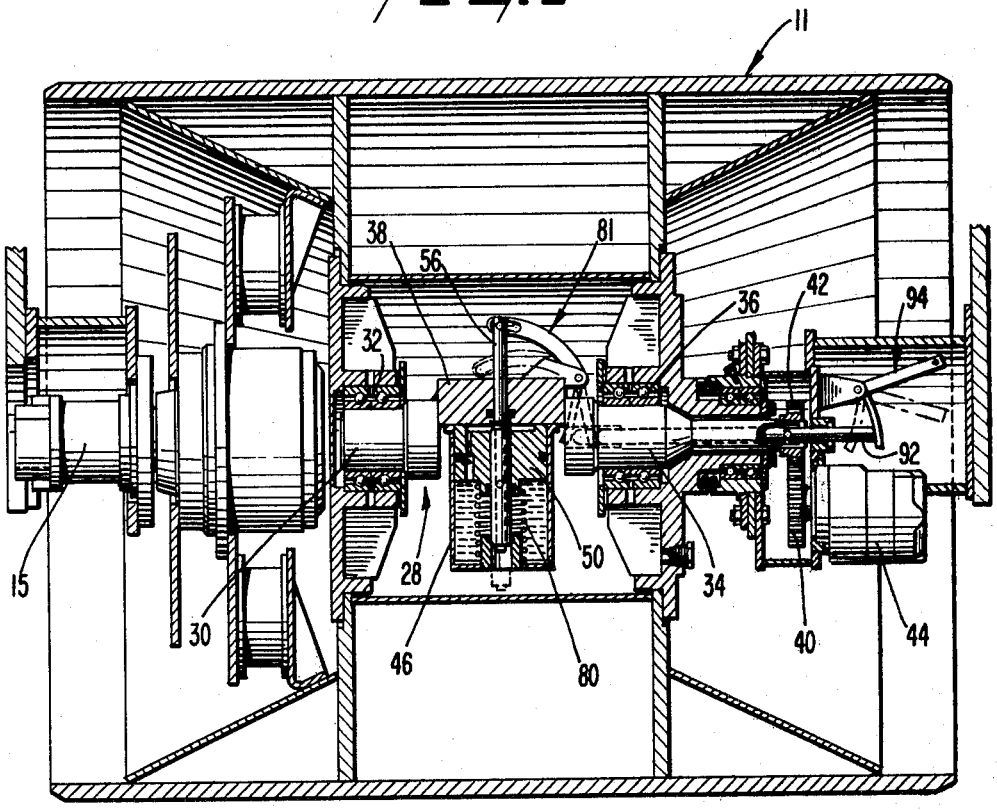
FIG. 2 is a longitudinal section through a vibrator mechanism of the roller assembly.

If it is desired to increase the amplitude of vibration, the operator actuates the lever 102 so as to pull the bar 92 away from the arm 84 thereby enabling the rod 56 to travel radially outwardly (i.e., downwardly as depicted in FIG. 2) under the effects of centrifugal force. Movement of the rod 56 stops when the arm 84 contacts the bar 92, the latter being disposed in a predetermined position corresponding to a desired amplitude of vibration by virtue of the actuation of the lever 102. Accordingly, the outer port 62 communicates with the outer chamber 52 and conducts fluid from the outer chamber portion to the inner chamber portion 54 as the mass 50 is displaced outwardly under the influence of centrifugal force. This action continues until the mass 50 is displaced sufficiently radially outwardly to cover the outer port 62. Accordingly, further radially outwardly displacement of the mass 50 is prevented.

When the vibrating mechanism is deactivated and comes to rest, the spring 80 forces the mass 50 in a radially inward direction. Accordingly, fluid within the inner chamber portion 54 is pressurized sufficiently to open the check valve 72 located within the bleed line 70. In this manner, fluid is conducted from the inner chamber portion 54 to the outer chamber portion 52 so as to allow a gradual radially inward displacement of the mass to a rest position.

In accordance with the present invention, an infinitely variable vibratory mass is provided which stops automatically reaching its selected position of adjustment. The storage space for fluid is disposed within the chamber for the adjustable mass, thereby eliminating the need for extensive fluid conduits and rendering the apparatus more compact and simplified.

Furthermore, the change of amplitude can be achieved by rotating the shaft in either direction thus allowing rotation of eccentric weights opposite to rotation of the roller drum to achieve the best compaction results.

It should now be apparent to those skilled in the art that there has been provided in accordance with this invention, an improved vibratory roller. Moreover, it will be apparent to those skilled in the art that numerous modifications, variations, substitutions and equivalents exist for features of the invention without departing from the spirit and scope thereof. Accordingly, it is expressly intended that all such modifications, variations, substitutions and equivalents which fall within the spirit and scope of the invention as defined in the appended claims be embraced thereby.

What is claimed is:

1. In a vibratory compacting roller apparatus of the type including a rotatable compacting roll; vibrator means operably connected to said roll to vibrate the latter, said vibrator means including shaft means rotatable relative to said roll, a casing rotatable with the shaft means and including a chamber and an eccentric mass disposed within the chamber, said mass being displaceable within said chamber transversely of the shaft means; and position regulating means for regulating the position of said mass within said chamber to provide variable amplitudes of vibration induced thereby; said position regulating means comprising a fluid storage space, passage means including a port communicable with said chamber for interconnecting said fluid storage space with a portion of said chamber on an outward side of said mass so that during rotation of said shaft said mass is displaced outwardly under the influence of centrifugal force to push fluid from said outer portion of said chamber and into said storage space to enable said mass to move radially outwardly to change the amplitude of vibration, the improvement comprising means mounting said port of said passage means for selective movement relative to said chamber and said mass, to position said port in selected locations in which said port is arranged to be closed-off in response to said eccentric mass reaching the selected location.

2. Apparatus according to claim 1, wherein said port is closed-off by an outer periphery of said mass.

3. Apparatus according to claim 2 wherein said storage space comprises a second portion of said chamber located on an inward side of said mass opposite said first-named portion of said chamber.

4. Apparatus according to claim 3, wherein said position regulating means includes a valve rod slidably mounted in said mass, said passage means and port formed in said rod, and manually actuable means for displacing said rod to shift said port relative to said mass.

5. Apparatus according to claim 4, including yieldable biasing means for urging said eccentric mass inwardly, and a valved bleed passage disposed in said mass to meter fluid from said inner portion to said outer portion of said chamber when said mass is displaced inwardly.

6. In a vibratory compacting roller apparatus of the type including a rotatable compacting roller; vibrator means operably connected to said roll to vibrate the latter, said vibrator means including shaft means rotatable relative to said roll in either direction, a casing rotatable with the shaft means and including a chamber and an eccentric mass disposed within the chamber, said mass being displaceable within said chamber transversely of the shaft means; and position regulating means for regulating the position of said mass within said chamber to provide variable amplitude for vibration induced thereby; said position regulating means comprising a fluid storage space, passage means including a port communicable with said chamber for interconnecting said fluid storage space with a portion of said chamber on an outward side of said mass so that during rotation of said shaft said mass is displaced outwardly under the influence of centrifugal force to push fluid from said outer portion of said chamber and into said storage space to enable said mass to move radially outwardly to increase the amplitude of vibration, the improvement wherein said storage space comprises a second portion of said chamber located on an inward side of said mass opposite said outer portion of said chamber; a valve rod slidably mounted in said mass, said passage means formed in said rod; manually actuable means for displacing said rod to shift said port outwardly relative to said mass to enable said mass to displace fluid from said outer portion to said inner portion of said chamber under the influence of centrifugal force until said mass reaches and covers said port of said passage whereupon further displacement of said mass is prevented.

7. A method of vibrating a vibratory compacting roller comprising the steps of:

A. rotating a casing operably connected to said roller such that a mass movably supported within a fluid chamber of said casing is acted upon by centrifugal force, an outer portion of said chamber being fluidly interconnectible with a storage space by means of a passage having a port communicable with said chamber, said port being movable relative to said chamber and said mass, B. moving said port relative to said chamber and said mass so that said mass is able to displace fluid through said port from said outer space to said storage space while traveling outwardly under the influence of centrifugal force so as to change the amplitude of vibration of said roller, and C. causing said displaced mass to cover said port to stop further outward displacement of said mass.

8. A method according to claim 7, wherein said port is opened by sliding a rod within said mass so that fluid travels from said outer portion to said storage space through a passage disposed in said rod, said storage space defined by an inner portion of said chamber.

* * * * *